US007104213B2

(12) United States Patent
Reynolds

(10) Patent No.: US 7,104,213 B2
(45) Date of Patent: Sep. 12, 2006

(54) HAWSER GUIDANCE SYSTEM FOR QUICK RELEASE MOORING HOOKS

(75) Inventor: Robert Reynolds, Beaconsfield (CA)

(73) Assignee: Dibblee Tools Ltd., Point Claire (CA)

( * ) Notice: Subject to any disclaimer, the term of this patent is extended or adjusted under 35 U.S.C. 154(b) by 0 days.

(21) Appl. No.: 10/288,876

(22) Filed: Nov. 6, 2002

(65) Prior Publication Data

US 2003/0084832 A1 May 8, 2003

(30) Foreign Application Priority Data

Nov. 6, 2001 (CA) ..... 2361120

(51) Int. Cl.
*B63B 21/04* (2006.01)
*B63B 21/16* (2006.01)

(52) U.S. Cl. ..... 114/230.2; 114/230.23; 114/230.3

(58) Field of Classification Search ..... 114/230.1, 114/230.2, 230.22, 230.23, 230.25, 230.26, 114/230.29, 230.3, 181; 294/82.1, 82.11, 294/82.15, 82.17, 82.3, 82.33; 242/397, 242/397.2, 615.12, 615.13
See application file for complete search history.

(56) References Cited

U.S. PATENT DOCUMENTS 2,896,995 A * 7/1959 Stephens ..... 294/82.33
3,054,635 A * 9/1962 Voss ..... 294/82.33
3,613,625 A 10/1971 Rudelius et al.
3,746,309 A 7/1973 Johnson
3,761,122 A 9/1973 Epstein
3,762,757 A * 10/1973 Epstein ..... 294/82.33
3,763,815 A 10/1973 Hodate
3,811,720 A 5/1974 Epstein
3,873,146 A * 3/1975 Houshar ..... 294/82.3
3,965,841 A 6/1976 Croese
4,024,935 A 5/1977 Sugimoto
4,033,553 A 7/1977 Sugimoto
4,033,554 A 7/1977 Sugimoto et al.
4,034,992 A * 7/1977 Epstein ..... 294/82.33
4,073,255 A 2/1978 Paul
4,109,602 A 8/1978 Voss
4,196,888 A 4/1980 Tande et al.
4,216,942 A 8/1980 Takamatsu et al.
4,249,765 A 2/1981 Janssen
4,272,706 A 6/1981 Somerville
4,387,659 A * 6/1983 Terauchi et al. ..... 114/199

(Continued)

FOREIGN PATENT DOCUMENTS

EP 0 612 653 8/1994

(Continued)

OTHER PUBLICATIONS

Translation: JP 63-093690 A*

*Primary Examiner*—Ajay Vasudeva
(74) *Attorney, Agent, or Firm*—Meyertons, Hood, Kivlin, Kowert & Goetzel, P.C.; Eric B. Meyertons

(57) ABSTRACT

The present invention provides a hawser guidance system, adaptable to a quick release mooring hook assembly, which is provided with a hook and a vertical arm supporting a rope carrier that can orient itself aligned with the direction of an incoming hawser or mooring cable, and, optionally, with a righting bar located in front of the hook for righting the eye, in such a way as to guide the eye of the hawser or mooring cable to the hook and to engage the hook of a quick release mooring hook assembly.

3 Claims, 4 Drawing Sheets

U.S. PATENT DOCUMENTS

| | | | | | |
|---|---|---|---|---|---|
| 4,389,907 | A | | 6/1983 | Epstein | |
| 4,462,329 | A | | 7/1984 | Brushaber | |
| 4,476,801 | A | | 10/1984 | Foster et al. | |
| 4,658,748 | A | * | 4/1987 | Epstein | 114/217 |
| 4,708,082 | A | | 11/1987 | Ohta et al. | |
| 4,714,288 | A | | 12/1987 | Tietze | |
| 4,722,293 | A | | 2/1988 | Foster et al. | |
| 4,729,332 | A | | 3/1988 | Ohta et al. | |
| 5,123,374 | A | * | 6/1992 | McMillan | 114/230.3 |
| 5,957,075 | A | | 9/1999 | Byrne, Sr. et al. | |
| 5,967,575 | A | | 10/1999 | Blake | |
| 5,984,586 | A | | 11/1999 | Wudtke | |
| 6,085,681 | A | | 7/2000 | Morton | |
| 6,089,547 | A | | 7/2000 | Juelich et al. | |

FOREIGN PATENT DOCUMENTS

| | | | | |
|---|---|---|---|---|
| JP | 57099489 | A | * | 6/1982 |
| JP | 57164882 | A | * | 10/1982 |
| JP | 59085015 | A | * | 5/1984 |
| JP | 63093690 | A | * | 4/1988 |
| SU | 477036 | A | * | 11/1975 |
| SU | 720097 | A | * | 3/1980 |
| WO | WO 00/57065 | | | 9/2000 |
| WO | WO 01/51346 | | | 7/2001 |

* cited by examiner

HAWSER GUIDANCE SYSTEM FOR QUICK RELEASE MOORING HOOKS

FIELD OF THE INVENTION

The present invention relates to mooring hook assemblies. More specifically, the present invention is concerned with a hawser guidance system for a mooring hook assembly.

BACKGROUND OF THE INVENTION

Generally, a boat or a ship is secured to a wharf or dock to a securing device, which is usually a mooring hook assembly, by a mooring cable, having a large eye or loop, running from the ship to the dock, which must be sufficiently tight to prevent excessive movements of the ship with respect to the dock. A messenger line is usually attached to the mooring cable and thrown to the mooring hook assembly. An operator standing on the dock receives and secures the messenger line, and makes sure that the big eye of the mooring cable is engaged into a hook of the mooring hook assembly.

A number of mooring hook assemblies are available in the art to fasten the mooring cable to secure the ship and also to release the mooring cable before the ship sails away from the dock. Mooring hook assemblies generally comprise a main body fixedly mounted on the dock and supporting a hook that may move between an open position and a closed position to secure the mooring cable by engaging the big eye thereof.

For example, U.S. Pat. No. 3,763,815 (Hodate) describes a releasable mooring hook assembly having one end pivotally mounted on an horizontal supporting surface of a dock and another end provided with a hook that can pivot between a first opposition in which a bight thereof is open toward the mounted end and a second position in which the bight is open in the opposite direction, the bight being spaced from a pivot axis of the hook so that a rope held in the hook in the first position tends to turn the hook into its second position.

On the one hand, rapid disengagement of the cable is usually difficult. U.S. Pat. No. 3,811,720 (Epstein) discloses a fastening means for a releasable mooring hook assembly that can be actuated by an operator on the dock to allow the cable to slip away from the fastening means so that the ship may sail away from the dock.

Still, engagement of the ship mooring cable to the mooring hook assembly mounted on the dock generally requires hard labor and may be dangerous since the cable is usually of a large diameter and heavy, even though efforts have been made in the art to provide improved mooring hook assemblies, such as by providing a multi-part rotatable lever to catch the cable (see U.S. Pat. No. 3,761,122 (Epstein) for instance).

Therefore, there is a need in the art for a hawser guidance system that facilitates engagement and disengagement of the mooring cable to and from the hook of a mooring hook assembly, without undue manual intervention, and even in adverse conditions as where wind or waves are present, for example.

OBJECT OF THE INVENTION

An object of the present invention is therefore to provide a hawser guidance system for a mooring hook assembly to facilitate engagement and disengagement of the mooring hook.

SUMMARY OF THE INVENTION

More specifically, in accordance with the present invention, there is provided hawser guidance system adaptable to a mooring hook assembly having a first end mounted on a wharf and a second end supporting a pivoting line engaging member, the hawser guidance system comprising a vertical arm mounted to the mooring hook assembly between the first and second ends thereof to catch and secure a messenger line attached to an incoming mooring cable running from a ship, so that an eye of the mooring cable is presented over the line engaging member to facilitate the line engaging member into the eye.

Other objects, advantages and features of the present invention will become more apparent upon reading of the following nonrestrictive description of specific embodiments thereof, given by way of example only with reference to the accompanying drawings.

DESCRIPTION OF A PREFERRED EMBODIMENT

Generally stated, the present invention provides a hawser guidance system for a mooring hook assembly. Since mooring hook assemblies are believed to be well known in the art, only the parts thereof necessary for the description of the hawser guidance system of the present invention will be mentioned herein; therefore mooring hook assemblies themselves will not be described in further detail.

Figure 1:
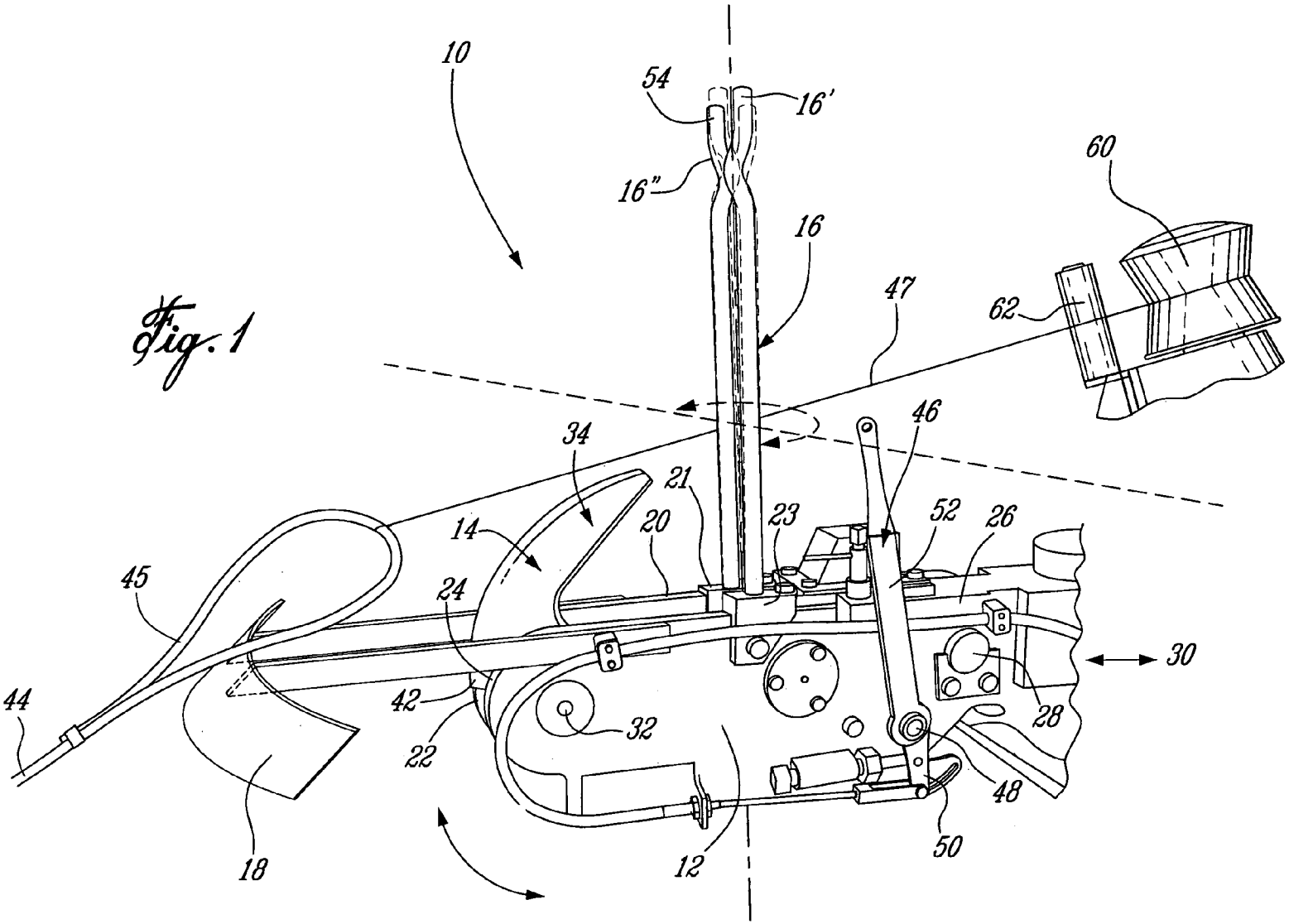
FIG. 1 is a side-view of a mooring hook assembly, in a closed position, provided with a hawser guidance system according to one embodiment of the present invention.
Figure 2:
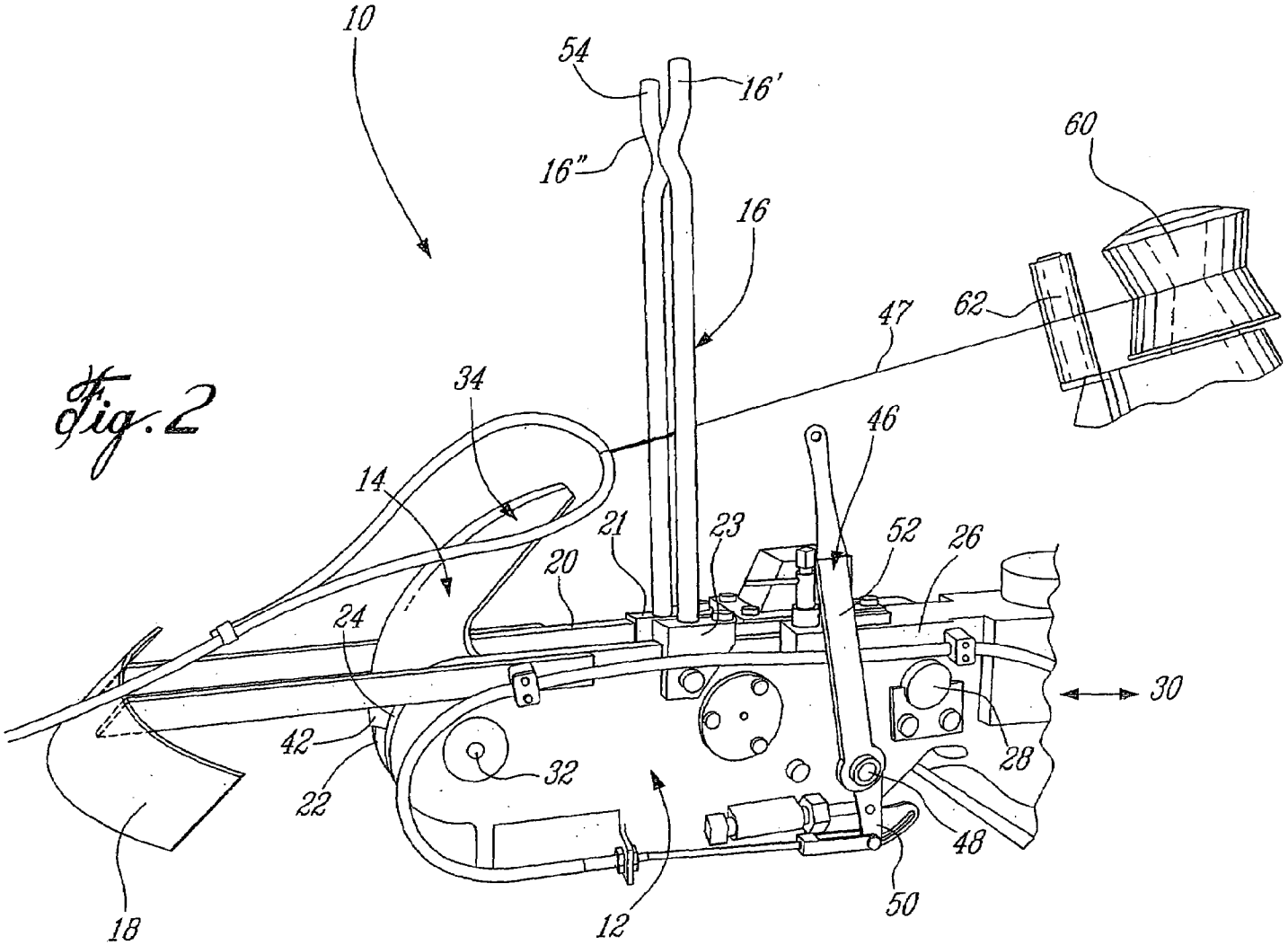
FIG. 2 is a side view of FIG. 1 showing the mooring cable being secured through engagement of the eve the mooring hook assembly.

As illustrated in FIGS. 1 and 2 of the appended drawings, the hawser guidance system 10 according to an embodiment of the present invention may be adaptable to a mooring hook assembly comprising an elongated hook supporting member 12 having one end 30 pivotally mounted on a surface of a wharf (not shown) and a line engaging member 14 pivotally attached to an other end of the elongated hook supporting member 12.

The elongated supporting member 12 conventionally comprises two spaced-apart plates 20 and 22, each comprising a lower end 24, which is of a generally curved or circular configuration, and an upper end 26. The plates 20 and 22 are fixedly attached to one another by a shaft 28 and jointly connected to a pivot assembly at the end 30 mounted on the horizontal wharf, not otherwise shown.

A free other end of the elongated supporting member 12 pivotally supports the line engaging member 14 on a shaft 32 connecting the two spaced-apart plates 20 and 22 and parallel to the shaft 28.

The line engaging member 14 is typically a U-shaped hook comprising a first leg 34 and a second leg (not seen in the Figures, located in between the two plates 20 and 22), each leg having a substantially rounded portion 38, and both legs having a common base 42 (best seen in FIG. 2). The U-shaped hook 14 is positioned between the two spaced-apart plates 20 and 22 and fastened on the lower end 24 thereof by the shaft 32, which extends through aligned apertures (not shown) in the two spaced-apart plates 20 and 22, in the base 42 and in the hook 14 respectively.

The hook 14 may be locked in a closed position illustrated in FIGS. 1 and 2 and may be unlocked in an open position thereof (not shown). During a pivoting movement of the hook 14 into the open position, the free end of the supporting member 12 and the hook 14 mounted thereon are moved upward and away from the surface of the wharf (not shown), by a mechanism including a release level 46. The release lever 46 is a rotatable lever attached on the upper end 26 of the two spaced-apart plates 20 and 22 by means of a bolt 48 running through aligned apertures (not shown) in the plates 20 and 22 and in a lower end of the release lever 46. The release lever 46 has a short leg 50 through which the bolt 48 passes, and a long leg 52. Such a mechanism is believed to be well known in the art and will not be further described herein. It allows a rapid release of the cable 44, since the hook 14 is pivoted by tension of the cable 44, by counter-balancing, after release of the locking mechanism. Once open, the hook 14 may be manually reset to the locked position of FIGS. 1 and 2.

The hawser guidance system 10 of the present invention comprises a vertical arm 16 mounted on the elongated hook supporting member 12 between the two ends thereof. The hawser guidance system 10 may further comprise a righting bar 18 located in front of the line engaging member 14.

The vertical arm 16 may comprises a pair of vertical rods 16' and 16", rising from mounting brackets 21, 23 provided on the plates 22 and 20 respectively. The vertical rods 16' and 16" are spaced-apart so that a messenger line 47 attached to the mooring cable 44 passes therebetween and drops all the way down. As may be seen from FIG. 1 to FIG. 2, an automatic swinging of the arm 16 is allowed under tension of the mooring cable 44 coming from a ship (not shown), which causes the arm 16 to orient itself aligned with the direction of the incoming mooring cable 44, permitting an eye 45 of the mooring cable 44 to presents itself above the hook 14 to facilitate engagement of the hook 14 into the eye 45.

Moreover, the vertical rods 16' and 16" may be so shaped to provide an neck region 54 to prevent the messenger line 47 from being pulled out when in a loose condition for example.

Obviously, the vertical arm 16 may be an articulating arm, a bracket or a rope carrier providing that it guides the messenger line 47 so that the eye 45 of the mooring cable 44 reaches a location over the hook 14 allowing a direct engagement of the hook 14 into the eye 45. Alternatively, a non-articulating arm may be used.

The righting bar 18 may be further located in front of the hook 14 for righting the eye 45, so as to straighten the mooring cable 44 if it gets twisted, and also to flatten the messenger line 47, in order to facilitate engagement of the hook 14 into the eye 45, and inversely, to ease disengagement of the hook 14 therefrom (in the open position). The righting bar 18 may be of a fairlead type or a roller-type. The righting bar 18 may be an open or closed-type. Its location relative to the hook 14 of the hawser guiding system 10 may vary, depending on the type and size of the mooring cable 44 and on an angle of approach of the boat to the deck for instance.

The hawser guiding system 10 advantageously includes a means of automatically swinging the vertical arm 16 to orient itself in the direction of the incoming mooring cable 44.

FIGS. 1 and 2 illustrate a mooring hook assembly in a closed position thereof, when the mooring cable 44 is being secured through engagement of the eye 45 and under strain. In that position, the second leg is inserted between the two spaced-apart plates 20 and 22, while the first leg 34 is in an upward position. An anticlockwise movement of an end 56 of the hook 14 allows the release of the eye 45 of the mooring cable 44, to the open position (not shown), as is well known in the art.

As should now be apparent, the hawser guidance system of the present invention generally comprises a vertical arm mounted on a mooring hook assembly at a distance from the hook thereof, which catches and guides a messenger line attached to an incoming mooring cable and may orient itself aligned with a direction of the incoming mooring cable. The hawser guidance system may further comprises a righting bar located in front of the hook for righting the mooring cable, in such a way that the messenger line is caught by the vertical arm in a generally flat horizontal position so that the mooring cable is untwisted and an eye thereof presents itself in a position above the hook allowing an easy engagement of the eye by the hook.

Figure 3:
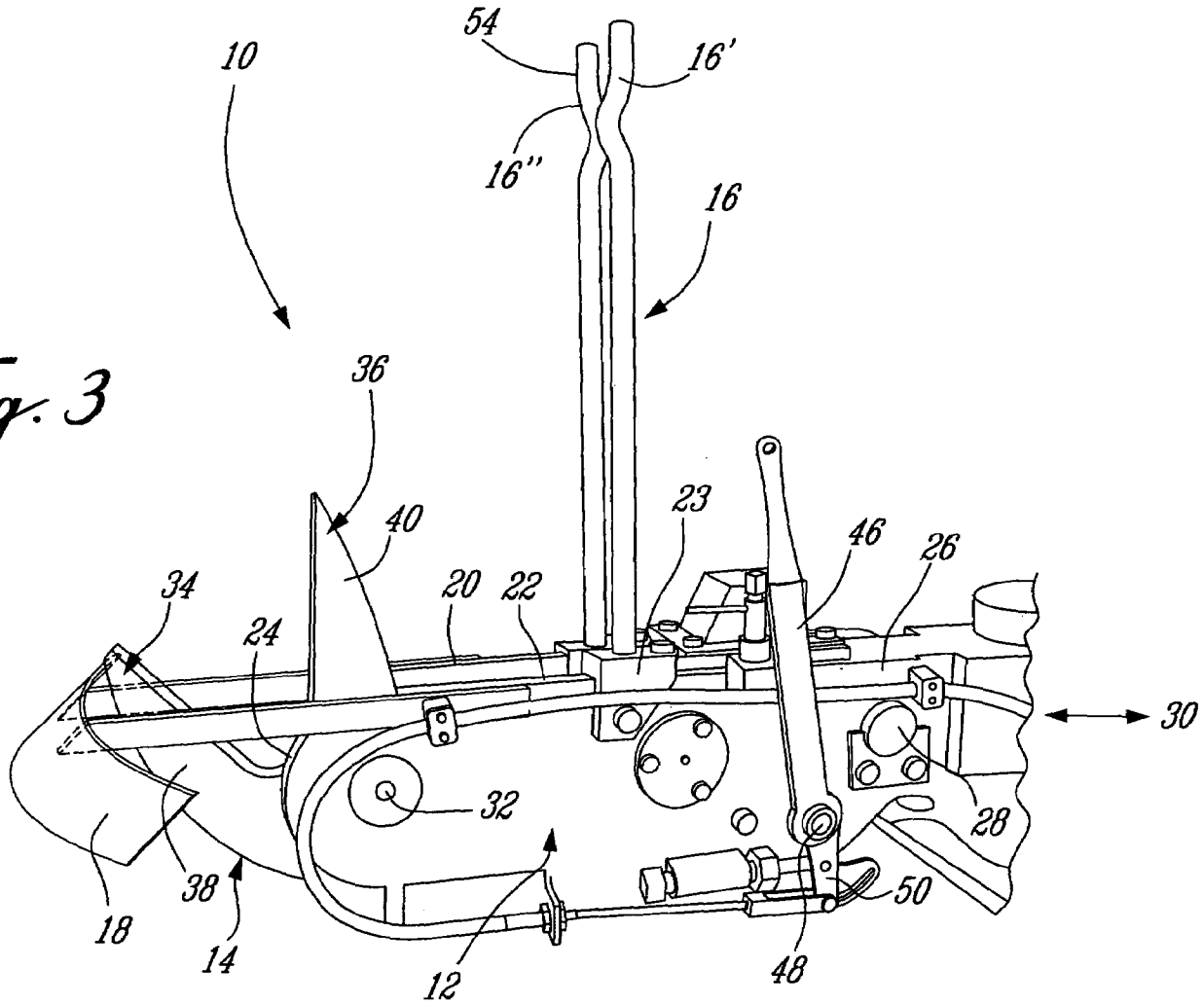
FIG. 3 is a side-view of the mooring hook assembly, in an open position, provided with the hawser guidance system of FIG. 1.
Figure 4:
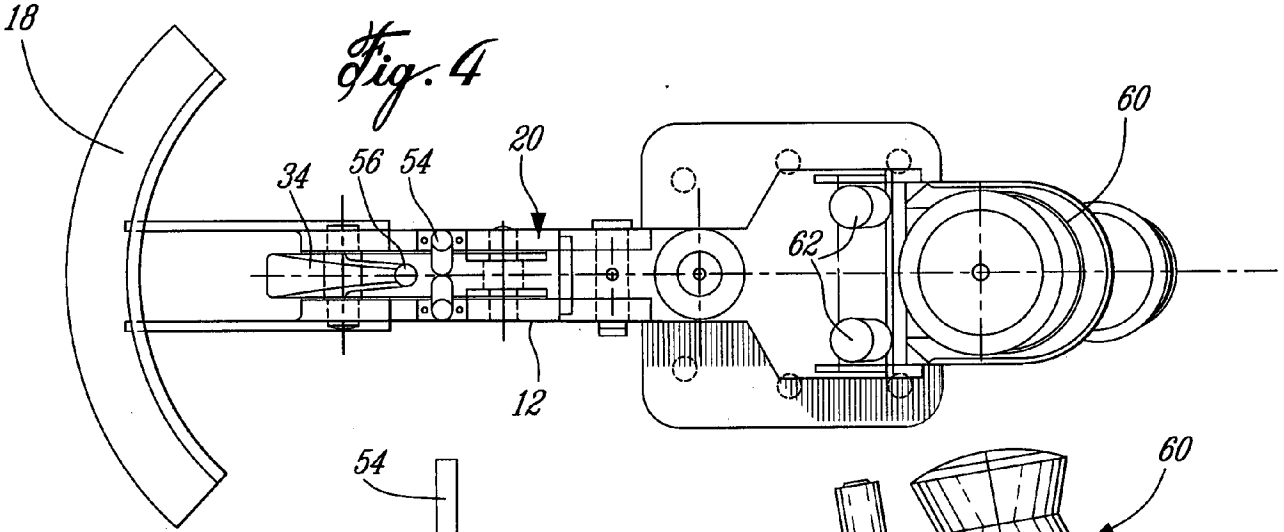
FIG. 4 is a top of the mooring hook assembly, in a fully closed position, provided with the hawser guidance of FIG. 1.
Figure 5:
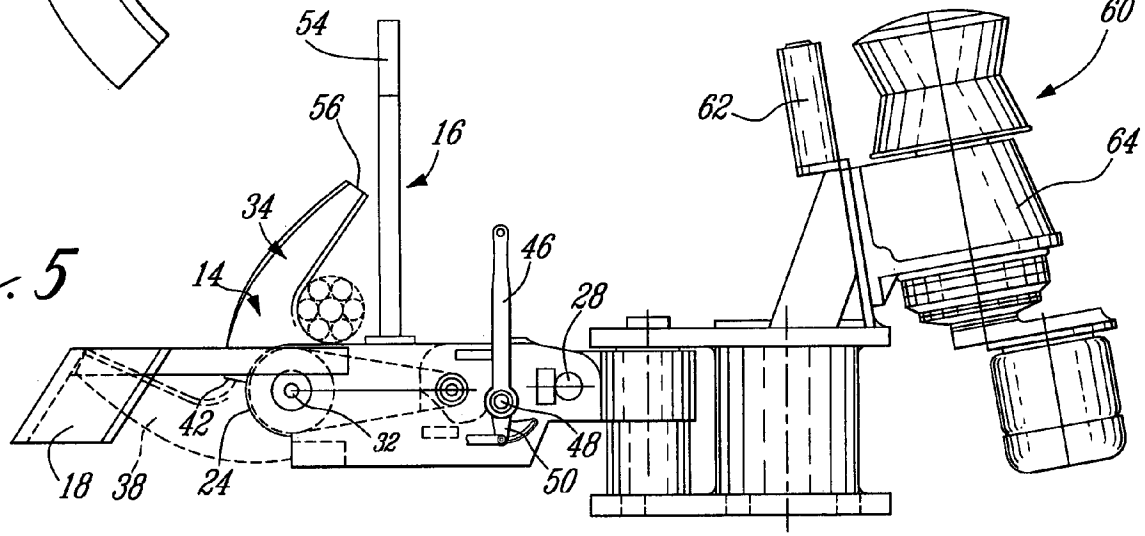
FIG. 5 is a side-view of the mooring hook assembly, in a fully closed position, provided with the hawser guidance system of FIG. 1 combined with a capstan.

In a further embodiment of the present invention, illustrated in FIGS. 3 and 4, the hawser guiding system of the present invention may further include a means to retrieve the messenger line 47, such as a power-operated capstan 60 (electrical, hydraulic or air-operated), which position and operation is integral with an automatic operation of the system according to the present invention. The capstan 60 may be part and on top of the mooring hook assembly on which the system 10 is adapted, as illustrated in the FIGS. 3 and 4, or separated therefrom on a platform, or even located behind. The capstan 60 is selected with characteristic that may advantageously include size, horse-power rating, capstan head design, shape and size, and positioning of the capstan 60 in relation to the hook 14 or vertical arm 16.

People in the art will appreciate that a winch may be substituted for the capstan 60.

Optionally, a roller fairlead 62, comprising for example pulleys or rollers arranged to permit reeling in of the messenger line 47 from any direction, may be used in conjunction with the capstan 60 to guide the messenger line 47 to a drum 64 of the capstan 60.

People in the art will also appreciate that a hawser guiding system according to the present invention may be adapted to any conventional mooring hook assembly as described herein, without requiring complicated, time-consuming and therefore expensive modifications thereof.

Although the present invention has been described hereinabove by way of specific embodiments thereof, it can be modified without departing from the spirit and nature of the subject invention, as defined in the appended claims.

What is claimed is:

1. A hawser guidance system adaptable to a mooring hook assembly having a first end mounted on a wharf and a second end supporting a line engaging member, said hawser guidance system comprising a vertical arm mounted to the mooring hook assembly between the first and second ends thereof independently of said line engaging member, said vertical arm guiding the mooring cable over the line engaging member, so that an eye of the mooring cable is presented over said line engaging member to facilitate said line engaging member into said eye, said hawser guidance system further comprising a means to retrieve a messenger line that is attached to the mooring cable, said means to retrieve being a power-operated capstan, said hawser guidance system further comprising a roller fairlead, said fairlead guiding the messenger line onto said capstan.

2. The hawser guidance system according to claim 1, wherein said vertical arm is selected from the group consisting of an articulating arm, a bracket, a rope carrier and a non-articulated arm.

3. The hawser guidance system of claim 1, further comprising a righting bar.

* * * * *